United States Patent [19]

Klein

[11] 4,294,035

[45] Oct. 13, 1981

[54] DEVICE WITH VISUAL AND AUDIO OUTPUT

[75] Inventor: David I. Klein, Columbia, Md.

[73] Assignee: George Eng, Rockville, Md. ; a part interest

[21] Appl. No.: 131,945

[22] Filed: Mar. 21, 1980

[51] Int. Cl.[3] ..... A63H 33/26

[52] U.S. Cl. ..... 46/227; 272/1 R; 250/206; 340/384 E

[58] Field of Search ..... 46/45, 118, 227, 228, 46/229, 232, 251, 256; 40/457; 84/1.18; 272/1 R; 340/384 E; 250/206

[56] References Cited

U.S. PATENT DOCUMENTS

| | | | |
|---|---|---|---|
| 2,838,876 | 6/1958 | Smith | 180/2 A |
| 3,294,397 | 12/1966 | Du Rand | 272/1 R |
| 3,294,401 | 12/1966 | Nicholas et al. | 46/227 |
| 3,308,577 | 3/1967 | Holt | 46/256 |
| 3,314,189 | 4/1967 | Carroll | 46/256 |
| 3,375,376 | 3/1968 | Kermode | 250/231 R |
| 3,406,481 | 10/1968 | Tachi | 46/256 |
| 3,803,593 | 4/1974 | Stampfli | 340/384 E |
| 3,849,931 | 11/1974 | Gully | 46/251 |
| 3,971,016 | 7/1976 | Pui | 340/384 E |
| ,4,086,724 | 5/1978 | McCaslin | 46/256 |
| 4,107,462 | 8/1978 | Asija | 40/457 |
| 4,160,339 | 7/1979 | Dankman et al. | 46/227 |

*Primary Examiner*—F. Barry Shay

*Attorney, Agent, or Firm*—Morton J. Rosenberg

[57] ABSTRACT

An amusement device (10) to produce an audio output from an audio transducer (76), as well as a visual output from a plurality of light emitting diode elements (68, 70, 72, 74). The light emitting diode elements (68, 70, 72, 74) are intermittently lighted in accordance with a predetermined first frequency determined by a first photoresistor element (52). The first photoresistor element (52) includes a circuit coupled to a first oscillator circuit (20) which determines the first predetermined frequency of the visual output system (66) responsive to the amount of photons impinging on first photoresistor element (52). Correspondingly, a second predetermined frequency for audio transducer (76) is determined by second photoresistor element (82) which is coupled to a second oscillator circuit (22) for producing the predetermined second frequency. A coupling line 96 is utilized between an output terminal (62) of the oscillator (20) and a reset terminal (94) of the second oscillator circuit (22) for providing a synchronous visual and audio output.

13 Claims, 2 Drawing Figures

DEVICE WITH VISUAL AND AUDIO OUTPUT

BACKGROUND OF THE INVENTION

1. Field of the Invention

This invention pertains to amusement devices. In particular, this invention relates to amusement devices having an audio and visual output. More in particular, this invention relates to an amusement audio and visual output device in which the frequency of the visual output and the frequency of the audio output may be varied in accordance with the wishes of the user. Still further, this invention relates to an audio/visual amusement device which uses a pair of photoresistor elements coupled to a pair of oscillator circuits in order to determine the frequencies of the visual and audio output systems. More in particular, this invention pertains to an audio/visual amusement device where a first frequency control circuit controls the visual output in the form of flashing light emitting diodes. Additionally, this invention relates to an audio/visual amusement device which includes a second frequency control circuit for determining the frequency of the audio output. Still further, this invention pertains to an audio/visual amusement device wherein the first frequency control circuit is coupled to the second oscillator circuit in order to maintain a synchronous audio and visual output.

2. Prior Art

Audio/visual amusement devices are well-known in the art. The best prior art known to the inventor includes U.S. Pat. Nos. 3,971,016; 4,160,339; 3,294,401; 3,308,577; 2,838,876; 3,375,376; 3,406,481; 3,849,931; 3,314,189; 4,086,724; and, 3,803,593. U.S. Pat. No. 3,971,016 is directed to a toy electronic chirping device. When a mechanical switch is placed in a closed position, a transistor is biased into a conduction operation mode. A capacitor charges up through the transistor in order to increase voltage. Eventually, the transistor conducts so that the capacitor discharges. The system uses a feedback arrangement and a cyclic process of charging and discharging of the capacitor which results in a warbling tone emitted from a speaker. Although this reference does direct itself to an audio output amusement device, such does not utilize photoresistor elements which may be covered or uncovered by the user to change frequency of the audio/visual output.

U.S. Pat. No. 4,160,339 shows other prior art which has an audio generator. In such prior art, there is a multi-tone signal generator with the signal applied to a filter and then through an amplifier to a speaker. Although such does change frequency, the frequency change is dependent upon the attitude of the system and is not directed to the coupling of photoresistor elements to oscillator circuits to provide frequency changes in the light and audio output responsive to the desires of the user.

SUMMARY OF THE INVENTION

An amusement device which includes an integrated circuit having first and second oscillator circuits contained therein for producing output signals at predetermined first and second frequencies, respectively. The amusement device also has power circuitry coupled to the integrated circuit means for activating the first and second oscillator circuits. Visual output circuitry is coupled to an output terminal of the first oscillator circuit for producing visual output responsive to the first frequency. A first frequency control circuit is coupled to the first oscillator circuit for modulating the first frequency output of the first oscillator circuit. An audio output mechanism is coupled to an output terminal of the second oscillator circuit for producing an audio output responsive to the second frequency. Further, a second frequency control circuit is coupled to the second oscillator circuit for modulating the second frequency output of the second oscillator circuit. Finally, coupling circuitry between the first frequency control circuit and the reset terminal of the second oscillator circuit is used for providing a synchronous visual output and audio output.

DESCRIPTION OF THE PREFERRED EMBODIMENTS

Figure 1:
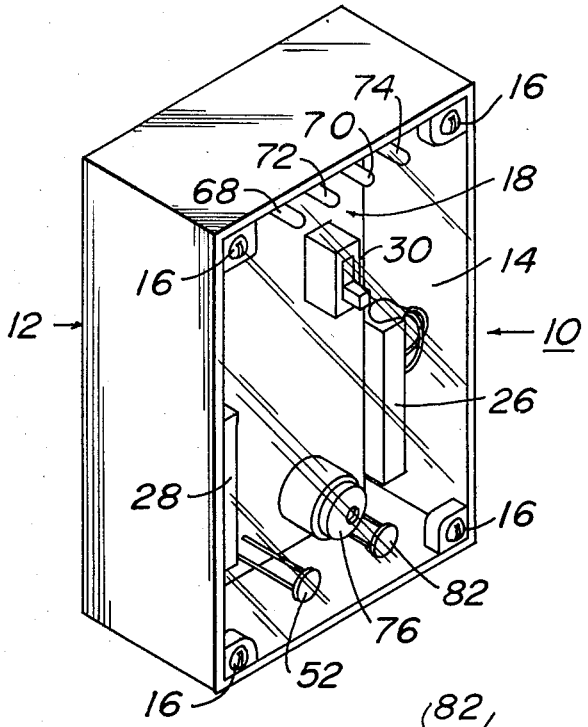
FIG. 1 is a perspective view of the amusement device.
Figure 2:
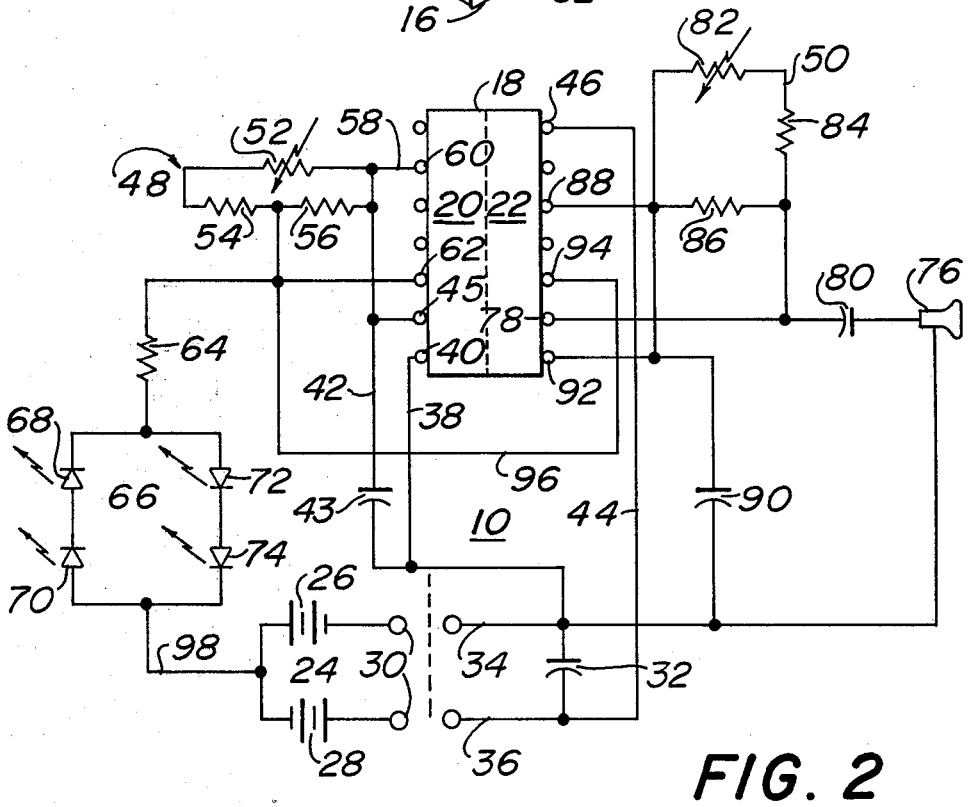
FIG. 2 is an electrical circuit diagram for the electrical components of the amusement device.

Referring now to FIGS. 1 and 2, there is shown amusement device 10 adapted to provide varying audio and visual effects responsive to user actuation. In particular, amusement device 10 provides a system whereby light means flash alternately in a pattern having a predetermined flashing or light actuation frequency. The frequency of the light flashing may be controlled by the user in a manner to be discussed in following paragraphs. Additionally, the particular concept includes an audio output means which has an audio frequency which may be varied by the user in combination with the light flashing frequency or independent of such. Still further, an electrical coupling between the visual output means and the audio output means allows for tone bursts to be produced in synchronism with the light means flashing to provide an unusual and amusing effect.

Amusement device 10, as is shown in FIG. 1, includes housing 12 which may be in the form of a parallelepiped contour and is adapted in size restrictions to be held in a user's hand. In general, housing 12 is closed in contour and may be formed of a plastic material in one-piece construction. Additionally, housing 12 includes frontal face plate member 14 which is fixedly secured to housing 12. Securement of frontal face plate member 14 may be through screws 16, adhesive bonding, or some like technique not important to the inventive concept, as is herein described. Frontal face plate member 14 may be formed of plastic material with an important concept being that plate member 14 be substantially transparent in composition nature. It is important that at least a portion of face plate member 14 be transparent or at least translucent to allow passage therethrough of photons to allow operation of amusement device 10, as will be described in following paragraphs. Additionally, the entire planar surface area of face plate member 14 may be transparent to provide the user with a visual effect of the enclosed electronic components.

The basis of amusement device 10 includes integrated circuit 18, as is shown in FIGS. 1 and 2. Integrated circuit 18 is of the type being composed of first oscillator circuit 20 and second oscillator circuit 22. First and second oscillator circuits 20 and 22 are diagrammatically represented on opposing sides of integrated circuit 18 by the phantom partition line merely used for representation purposes. Integrated circuit 18 is a commercially available IC package and may be considered to be a dual monolithic timing circuit which is a stable controller capable of time delays and oscillation. Integrated circuit 18 is produced by Signetics Corporation, and bears the Model Number NE/SE556. Additionally, integrated circuit 18 being used in amusement device 10 is clearly shown in Signetics Digital Linear MOS Data Book, Copyright 1974 by Signetics Corporation, and outlined on pages 6–67, and 6–68. As is the usual case in such dual monolithic timing circuits, such contain a digital comparator and a voltage controlled oscillator and in the present amusement device 10, acts as a multivibrator adapted for reset, as will be detailed in following paragraphs.

Amusement device 10 further includes power mechanism 24 composed of first and second DC batteries 26 and 28. Power mechanism 24 and particularly first and second batteries 26 and 28, are coupled to integrated circuit 18 through double pole switch 30 for actuating first and second oscillator circuits 20 and 22 within integrated circuit 18. As can be seen, first and second batteries 26 and 28 are mounted in opposing polarity to single throw double pole switch 30. First and second batteries 26 and 28 are any one of a number of standard DC batteries commercially available. One such type battery is a 9.0 volt power system produced by Union Carbide Corporation. As diagrammatically represented in FIG. 2, first battery 26 supplies negative voltage and second battery 28 provides positive voltage through double pole switch 30. First capacitor 32 is coupled to switch output lines 34 and 36, in parallel relation. First capacitor 32 is commercially available and may be a 0.01 Uf type capacitor rating. First capacitor 32 is a capacitor filter which is utilized to filter any noise generated by oscillators 20 and 22 within integrated circuit 18. Positive voltage on switch output line 36 passes through lead line 44 to terminal 46 which is a positive voltage providing the positive supply voltage for integrated circuit 18. Integrated circuit return voltage terminal 40 is coupled to switch output line 34 through return voltage line 38 which provides a return path for the supply voltage. Thus, coupling to terminals 46 and 40 of integrated circuit 18 completes the power requirements for integrated circuit 18.

First frequency control circuit means 48 is coupled to first oscillator circuit 20 for modulating a first frequency output of first oscillator circuit 20. First frequency control means 48 includes first photoresistor element 52 which is a commercially available semiconductor resistor which, when impinged by photons, drops in resistance value. First photoresistor element 52 is commercially available from Clairex Corporation, and has a designation of Model CL-7P5HL. Additionally, first frequency control circuit 48 includes first frequency control capacitor 43 having a capacitance value approximating 10.0 Uf, coupled to switch output line 34 and trigger terminal 45 of oscillator circuit 20. First photoresistor element 52 is biased by a pair of biasing resistors 54 and 56. Each of biasing resistors 54 and 56 are commercially available and respectively have resistance values of 10.0KΩ and 220.0KΩ. Obviously, the biasing limits the range of oscillation to the predetermined value of biasing resistor 56 as the resistance of first photoresistor element 52 passes in an upward manner. Additionally, as photoresistor element 52 goes low, the oscillation is limited to the value of the parallel combination of biasing resistors 54 and 56. Thus, the overall frequency range of first oscillator circuit 20 is bounded in both the high and the low range. First frequency control circuit means 48 is coupled to integrated circuit 18 through first frequency control input line 58 being coupled to frequency control or threshold input terminal 60 of first oscillator circuit 20. Output of first oscillator circuit 20 passes from output terminal 62 through output resistor 64 which may be a standard 1.0KΩ resistor element. Output resistor 64 is utilized to limit the current passing to visual output system 66.

Visual output system 66 is coupled to output terminal 62 through output resistor 64 for producing visual output responsive to a predetermined first frequency from first oscillator circuit 20 governed by first frequency control means 48. Visual output system 66 includes a first pair of light emitting diode elements 68 and 70 coupled each to the other in series relation, as is shown in FIG. 2. Additionally, second pair of light emitting diode elements 72 and 74 are similarly coupled each to the other in series relation. As can be seen, first and second pairs of light emitting diode elements 68, 70 and 72, 74 are connected in parallel relation to output resistor 64 and output terminal 62 of first oscillator circuit 20. First and second pairs of light emitting diode elements 68, 70 and 72, 74 are mounted in opposing electrical biased manner, each pair with respect to the other, for alternating light activation of elements 68, 70, 72 and 74. This allows an alternate flashing from one pair of elements to a next successive pair of diode elements.

Amusement device 10 further includes audio output mechanism 76 coupled to output terminal 78 of second oscillator circuit 22 for producing an audio output responsive to a second predetermined frequency. Audio output mechanism 76 may be one of a number of commercially available speaker units. One such speaker unit is manufactured by Star Micronics, Inc., having a Model Designation Number QMB-01. Audio output mechanism or speaker 76 is coupled to output terminal 78 through coupling capacitor 80 which may be a standard 10.0 Uf valued capacitor element.

Second frequency control circuit means 50 is coupled to second oscillator circuit 22 for modulating the predetermined second frequency output of second oscillator circuit 22. Second frequency control circuit 50 is composed of second photoresistor element 82 which is one of a number of commercially available photoresistor elements. The particular second photoresistor element 52 being utilized is manufactured by the Clairex Corporation, and has a Model Designation CL-7P5HL. Second photoresistor element 82 is connected to secondary biasing resistors 84 and 86, the combination being coupled to second oscillator circuit 22 at threshold input terminal 88. Secondary biasing resistor 86 essentially limits the resistance of the frequency control circuit when photoresistor 82 goes to a high resistance value. Additionally, the parallel combination of secondary biasing resistors 84 and 86 limits the resistance of the frequency control circuit when photoresistor 82 goes to a low resistance value. Resistor elements 84 and 86 are standard resistor elements which are commercially available and may have a value of 2.2KΩ and 10.0KΩ, respectively. Additionally, second frequency control circuit control means 50 includes second frequency control capacitor elements 90 coupled to switch output line 34 and trigger terminal 92 of oscillator circuit 22. Second frequency control capacitor 90 may have an approximate value of 0.1 Uf.

First oscillator circuit 20 and second oscillator circuit 22 are coupled to coupling line 96 connected on opposing ends thereof to output terminal 62 and reset terminal 94 of second oscillator circuit 22. Coupling in this manner provides for an audio output from transducer 76 which is synchronous with the visual output. In this manner, first frequency control circuit means 48 is coupled to second oscillator circuit 22 in order to allow variation of the length of the tone in synchronism with the frequency of actuation of light emitting diodes 68, 70, 72, and 74. Thus, in this manner, the length of the audio tone is modulated by first frequency control circuit means 48, however, the predetermined second frequency of the audio signal acts independent of first frequency control circuit 48 and responsive to second frequency control circuit 50. As can be seen from FIG. 2, visual output system 66 is coupled to power system 24 through line 98. Batteries 24 and 26 are utilized to provide a voltage swing output from oscillators 20 and 22 to go between plus 9 volt battery 28 and minus 9 volt battery 26. Referencing light emitting diodes 68, 70, 72 and 74 to the zero potential or juncture between plus and minus 9 volt batteries 26 and 28, permits the voltage to swing to plus and minus values and light one pair of light emitting diode elements during half a cycle and to light the other pair of light emitting diode elements during the next half cycle, providing an alternating effect between the pairs of light emitting diode elements coupled to the same output.

Although this invention has been described in connection with specific forms and embodiments thereof, it will be appreciated that various modifications other than those discussed above may be resorted to without departing from the spirit or scope of the invention. For example, equivalent elements may be substituted for those specifically shown and described, and certain features may be used independently of other features, and in certain cases, particular locations of elements may be reversed or interposed, all without departing from the spirit or scope of the invention as defined in the appended claims.

What is claimed is:

1. An amusement device comprising:

(a) integrated circuit means having first and second oscillator circuits contained therein for producing output signals at predetermined first and second frequencies respectively;

(b) power means coupled to said integrated circuit means for activating said first and second oscillator circuits;

(c) visual output means coupled to an output terminal of said first oscillator circuit for producing visual output responsive to said first frequency;

(d) first frequency control means coupled to said first oscillator circuit for modulating said first frequency output of said first oscillator circuit;

(e) audio output means coupled to an output terminal of said second oscillator circuit for producing an audio output responsive to said second frequency;

(f) second frequency control means coupled to said second oscillator circuit for modulating said second frequency output of said second oscillator circuit;

(g) coupling means between said first frequency control means and a reset terminal of said second oscillator circuit for providing a synchronous visual output and audio output; and, (h) an enclosed housing within which said integrated circuit means, said power means, said visual output means, said first and second frequency control means, said audio output means and said coupling means are contained and secured thereto.

2. The amusement device as recited in claim 1 where said enclosed housing having a substantially parallelepiped contour, said housing having a volume adapted for holding in a hand of a user.

3. The amusement device as recited in claim 2 where said enclosed housing includes a frontal face plate member, said frontal face plate member being at least partially transparent.

4. The amusement device as recited in claim 3 where said power means includes switch means for activating and deactivating said power means, said switch means extending at least partially external said enclosed housing.

5. The amusement device as recited in claim 3 where said frontal plate member is substantially transparent throughout an extended surface area, said frontal plate member being formed of a plastic material composition.

6. The amusement device as recited in claim 1 where said first frequency control means includes first photoresistor means coupled to said first oscillator circuit for varying said first frequency of said first oscillator circuit responsive to a first quantity of photons impinging on a first photoresistor element.

7. The amusement device as recited in claim 6 where said visual output means is coupled to an output terminal of said first oscillator circuit and to said first photoresistor means for actuating said visual output means responsive to said first frequency of said first oscillator circuit.

8. The amusement device as recited in claim 7 where said visual output means includes:

(a) a first pair of light emitting diode elements, said first pair of light emitting diode elements coupled each to the other in series relation; and, (b) a second pair of light emitting diode elements, said second pair of light emitting diode elements being coupled each to the other in series relation, said first and second pairs of light emitting diode elements being connected in parallel relation to said output terminal of said first oscillator circuit.

9. The amusement device as recited in claim 8 where said first and second pairs of light emitting diodes are mounted in an opposing electrical biasing manner each with respect to the other for alternating light activation of said light emitting diode elements.

10. The amusement device as recited in claim 1 where said second frequency control means includes second photoresistor means coupled to said second oscillator circuit for varying said second frequency of said second oscillator circuit responsive to a second quantity of photons impinging on a second photoresistor element.

11. The amusement device as recited in claim 10 where said audio output means is coupled to an output terminal of said second oscillator circuit and to said second photoresistor means for actuating said audio output means responsive to said second frequency of said second oscillator circuit.

12. The amusement device as recited in claim 1 where said power means includes a pair of DC battery elements coupled in parallel relation to said visual output means.

13. The amusement device as recited in claim 12 where each of said DC battery elements is coupled to a double pole switch element, said coupling having opposing battery polarities with respect to said switch element.

* * * * *